US012434346B2

(12) United States Patent
Kündig

(10) Patent No.: US 12,434,346 B2
(45) Date of Patent: Oct. 7, 2025

(54) DEVICES AND METHODS FOR THE LATERALLY PRECISELY DEFINED USE OF SANDING BELTS ON BELT SANDING MACHINES IN CONTINUOUS OPERATION

(71) Applicants: KÜNDIG AG, Wetzikon (CH); Stephan Kündig, Rapperswil (SG)

(72) Inventor: Stephan Kündig, Rapperswil (CH)

(73) Assignees: KÜNDIG AG, Wetzikon (CH); Stephan Kündig, See-Gaster (CH)

( * ) Notice: Subject to any disclaimer, the term of this patent is extended or adjusted under 35 U.S.C. 154(b) by 0 days.

(21) Appl. No.: 17/769,425

(22) PCT Filed: Oct. 9, 2020

(86) PCT No.: PCT/IB2020/000769
§ 371 (c)(1),
(2) Date: Apr. 15, 2022

(87) PCT Pub. No.: WO2021/074681
PCT Pub. Date: Apr. 22, 2021

(65) Prior Publication Data

US 2024/0123563 A1 Apr. 18, 2024

(30) Foreign Application Priority Data

Oct. 16, 2019 (CH) ..... 01321/19

(51) Int. Cl.
*B24B 21/08* (2006.01)
*B24B 7/28* (2006.01)

(52) U.S. Cl.
CPC ..... *B24B 21/08* (2013.01); *B24B 7/28* (2013.01)

(58) Field of Classification Search
CPC ..... B24B 21/08; B24B 21/06; B24B 21/04; B24B 21/10; B24B 21/12; B24B 21/14;
(Continued)

(56) References Cited

U.S. PATENT DOCUMENTS 2,985,989 A * 5/1961 Knost ..... B24B 7/12 451/260
6,299,517 B1 * 10/2001 Weber ..... B24B 7/28 451/299

(Continued)

FOREIGN PATENT DOCUMENTS

DE 1 502 449 A1 7/1969
DE 92 14 527 U1 1/1993

(Continued)

OTHER PUBLICATIONS

Jan. 12, 2021 International Search Report issued in International Patent Application No. PCT/IB2020/000769.

(Continued)

*Primary Examiner* — David S Posigian
*Assistant Examiner* — Michael A Gump
(74) *Attorney, Agent, or Firm* — Oliff PLC

(57) ABSTRACT

A device has laterally mobile pressure devices on belt sanders in throughfeed, which are brought into position so that workpieces detected by detectors are sanded in a laterally limited area in the longitudinal direction. An arrangement of such pressure arrangements represents, for example, a segmented sanding pad. The method of lateral movement of its segments and the devices created for this purpose enable, among other things, the sanding of frames in the wood grain direction of their individual parts and/or their center panel as well as the application of sanding patterns to workpiece surfaces.

4 Claims, 4 Drawing Sheets

(58) Field of Classification Search
CPC ..... B24B 21/20; B24B 21/22; B24B 21/008; B24B 7/28; B24B 7/06; B24B 7/12; B24B 49/12; B24B 17/028; B24B 9/002; B24B 9/005
USPC ..... 451/28, 303, 300, 296, 297, 311
See application file for complete search history.

(56) References Cited

U.S. PATENT DOCUMENTS

| | | | | |
|---|---|---|---|---|
| 2006/0172661 | A1* | 8/2006 | Kundig | B24B 21/08 451/296 |
| 2017/0057045 | A1* | 3/2017 | Sung | F25D 11/00 |
| 2020/0122290 | A1* | 4/2020 | Bettermann | B24B 21/14 |

FOREIGN PATENT DOCUMENTS

| | | | | |
|---|---|---|---|---|
| DE | 43 16 588 | C1 | 9/1994 | |
| DE | 200 03 656 | U1 | 7/2000 | |
| EP | 1 070 567 | A1 | 1/2001 | |
| EP | 3305467 | A1 * | 4/2018 | B24B 21/06 |
| WO | 93/23203 | A1 | 11/1993 | |
| WO | 2004/009290 | A1 | 1/2004 | |

OTHER PUBLICATIONS

Feb. 2, 2022 International Preliminary Report on Patentability issued in International Patent Application No. PCT/IB2020/000769.

* cited by examiner

DEVICES AND METHODS FOR THE LATERALLY PRECISELY DEFINED USE OF SANDING BELTS ON BELT SANDING MACHINES IN CONTINUOUS OPERATION

BACKGROUND

The invention relates to the field of belt sanding technology.

State-of-the-art are sanding units with pressure elements acting over the whole or part of the working width, so-called segmented sanding pads (DE1502449A1, Heesemann Karl, 03.07.1969). Compared to conventional sanding pads with a continuous pressure plate, such pads offer the advantage of being adjusted to the approximate width of the workpiece to be sanded and are usually adequately metered. However, the width of the segments limits the precision of their insertion in the direction transverse to the feed. A more precise positioning of pressure segments is described in the utility model DE 200 03 656 U 1 (Weber Georg, 06.07.2000) with belt units that can be moved transversely to the direction of feed. This solution, however, proves to be impractical, since the inertia of the lateral displacement of the belt units only permits successive loading with workpieces at, in addition, only low feed rates and thus stands in the way of an economically justifiable throughput. The constant replacement of the short and thus quickly worn sanding belts would also prove to be equally impractical and uneconomical, especially when using several belt units, which would be a prerequisite for a profitable throughput. Methods and devices based on such a principle or design are therefore not known in practice to date. State of the art is also a device for the laterally precisely defined use of a sanding belt (WO 93/23203 A1, Kündig AG, Kündig Stephan, 25.11.1993), which, however, is based on a single mobile pressure device on a cross sanding unit and has therefore not proven to be economical. Furthermore, a device with two pressure devices (DE 92 14 527 U1, Paul Ernst Maschinenfabrik GmbH. 01.07.1993), the lateral use of which, however, is not guaranteed to be sufficiently precise. In addition, a device (WO 2004/009290 A1, Kündig AG, Kündig Stephan, 29.01.2004) with a sanding pad with angularly movable segments. However, the need for a practical, laterally precisely defined application of a sanding belt to a workpiece has actually existed for a very long time, not only for the frame sanding mentioned in the above-mentioned utility model specification, but also generally for delimiting longitudinal sanding, for example for accurately dimensioned longitudinal strips on workpiece edges, if these have to be roughened for glue application, for example. Another application for the precise lateral use of a sanding belt would be the creation of targeted sanding marks for the purpose of designing linear drawings, lettering or shaped surfaces on workpieces.

SUMMARY

Previously unknown and part of the present invention are individual or several laterally precisely displaceable pressure elements or devices in the form of narrow sanding pads or contact rollers under a sanding belt covering the entire working width of a throughfeed device—in contrast to the above-mentioned utility model specification-which, thanks to their sideways movement, allow the sanding of precisely assignable longitudinal paths. Such pressure elements can, for example, be segments of a segmented sanding pad and the task solved by this invention is understood to mean that the segments of a segmented sanding pad can be freely displaced and thus placed in a targeted manner.

BRIEF DESCRIPTION OF THE DRAWINGS

To illustrate the present patent application.

DETAILED DESCRIPTION OF EMBODIMENTS

Figure 1:
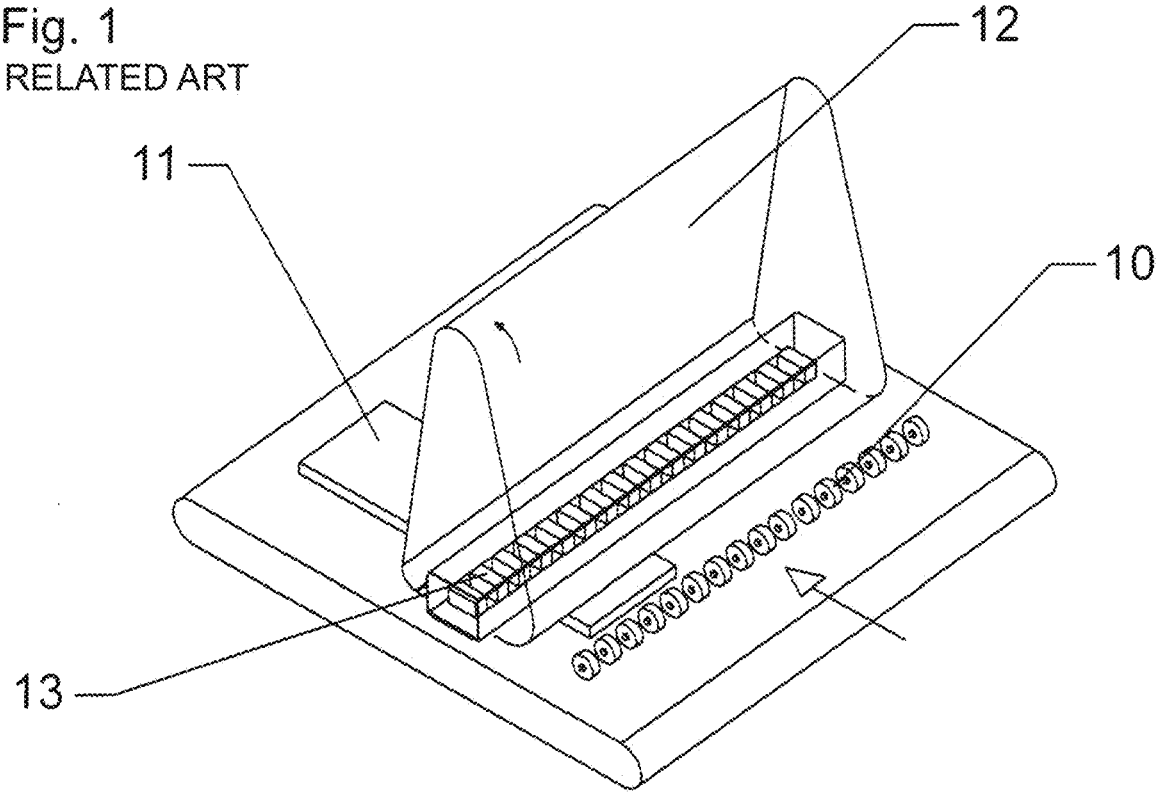
Fig. 1 RELATED ART
FIG. 1 illustrates a perspective view of a prior art sanding device.
Figure 2:
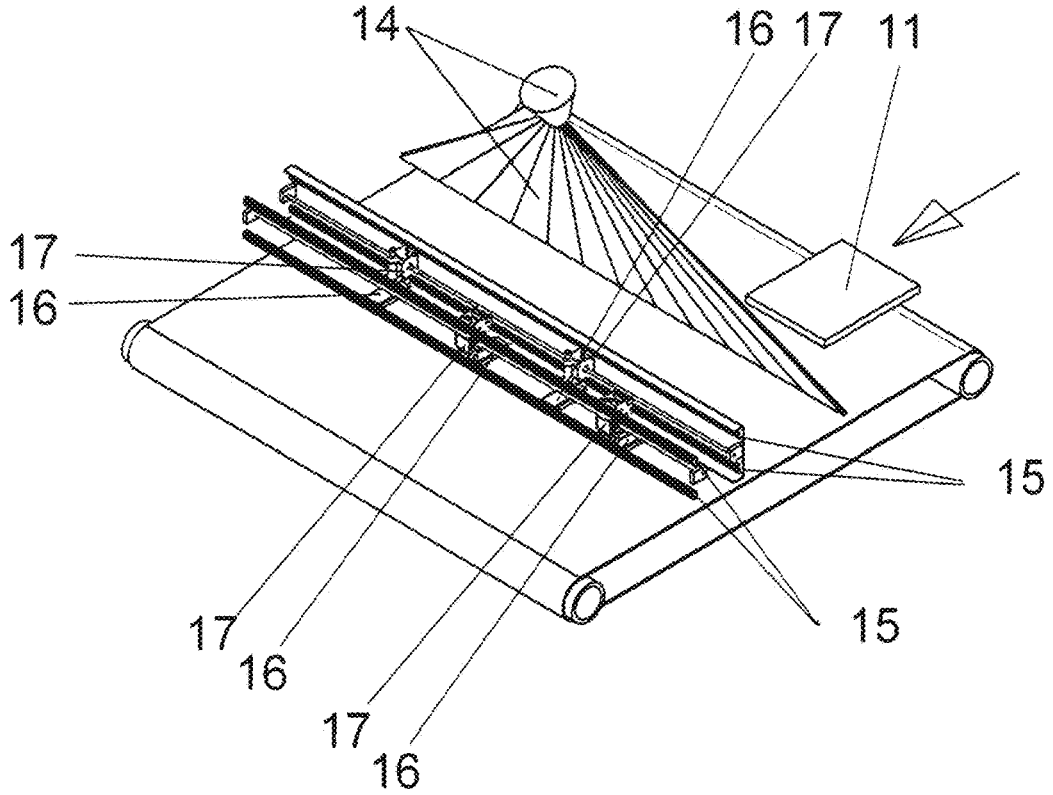
FIG. 2 illustrates a perspective view of the sanding device according to this disclosure.

FIG. 1 illustrates a prior art sanding device with a sensing device 10 and several laterally non-movable pressure elements acting on the sanding belt 12 according to the approximate width of the workpiece 11. The segments 13 of a segmented sanding pad are of the conventional type. FIG. 2 illustrates a sanding device according to the invention with a detector 14, two transverse guides 15, laterally mounted mobile pressure devices 16 and servomotors 17 that are used to move the mobile pressure devices 16, in place of which there can also be a central, controlled drive. When using the device described by the invention and shown in FIG. 2, workpieces 11 are detected at their lateral edges by a detector 14, for example a camera or a laser device. A control unit brings the mobile pressure devices 16 on the guides 15 into the corresponding lateral position by means of linear movement, for example servomotors 17 (actuators) and spindles, and controls their use. Any deviations from the right-angled infeed of the workpieces 11 are compensated for by the control system.

Figure 3:
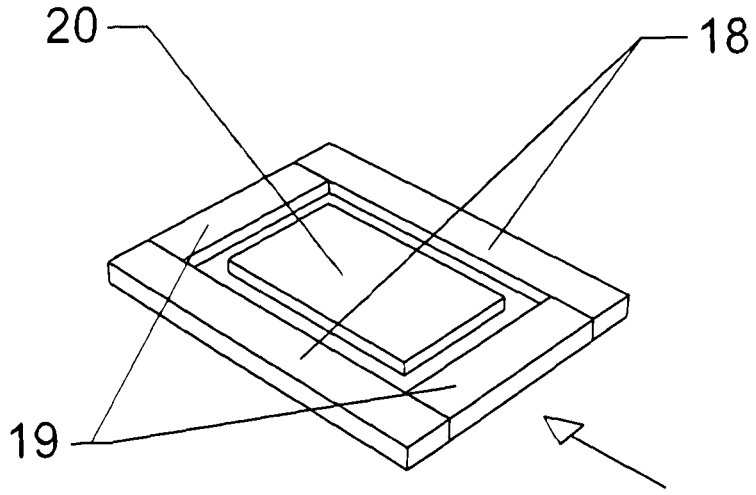
FIG. 3 illustrates a perspective view of a workpiece.
Figure 4:
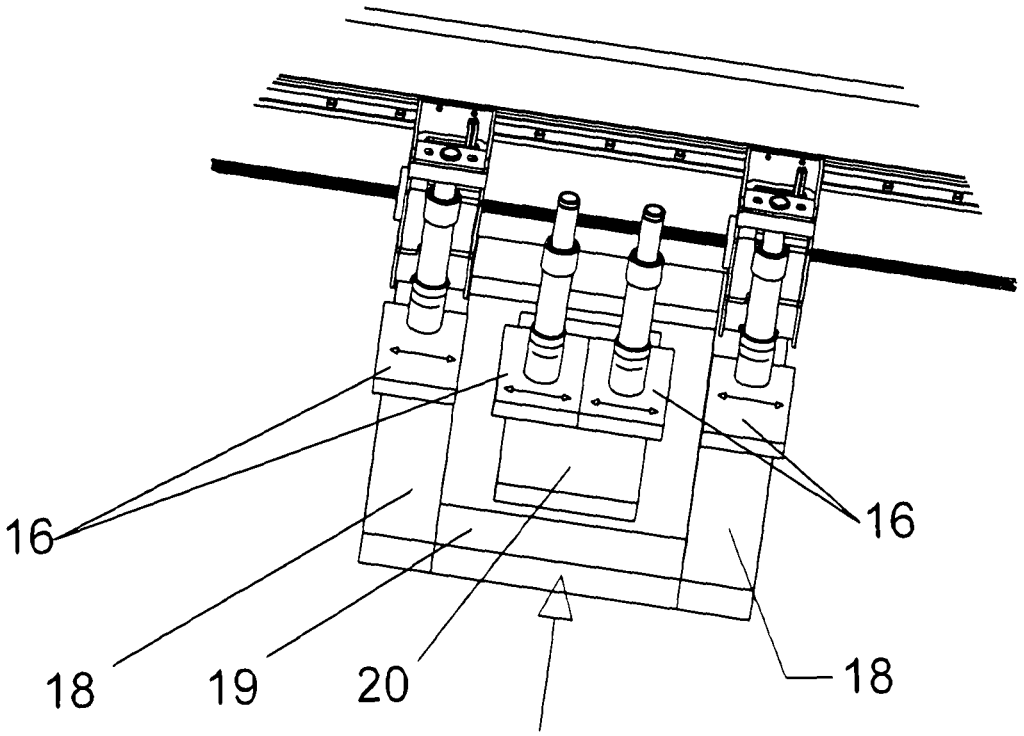
FIG. 4 illustrates a view of the mobile pressure devices on the workpiece.
Figure 5:
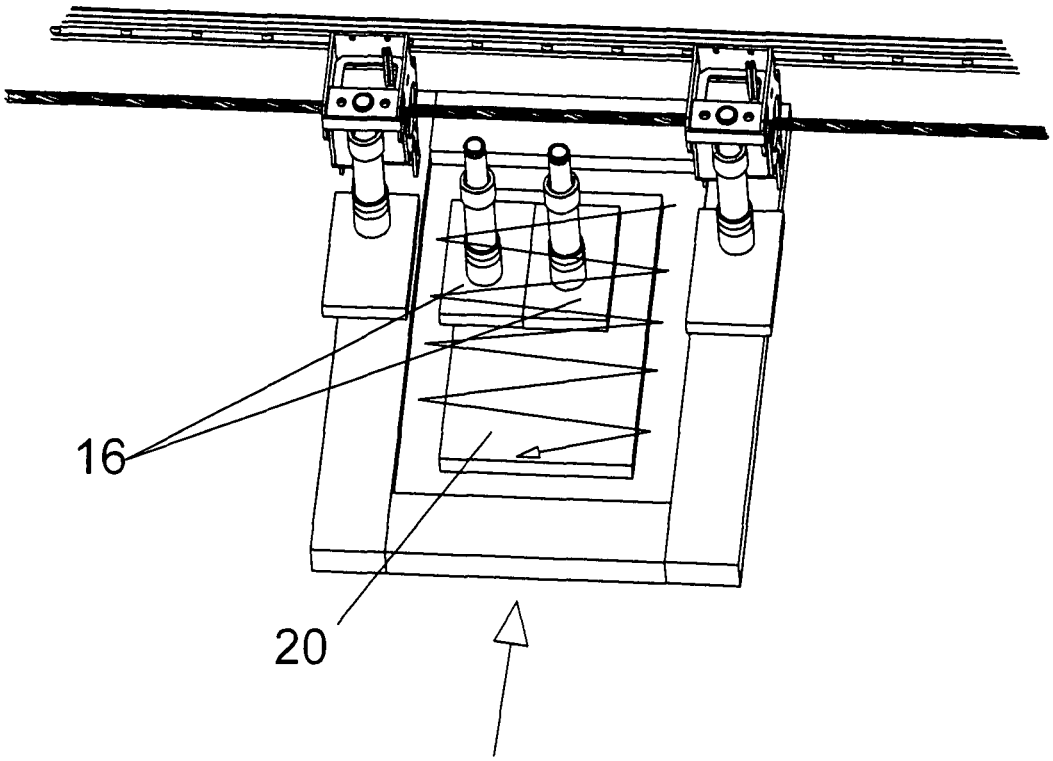
FIG. 5 illustrates another view of the mobile pressure devices on the workpiece.
Figure 6:
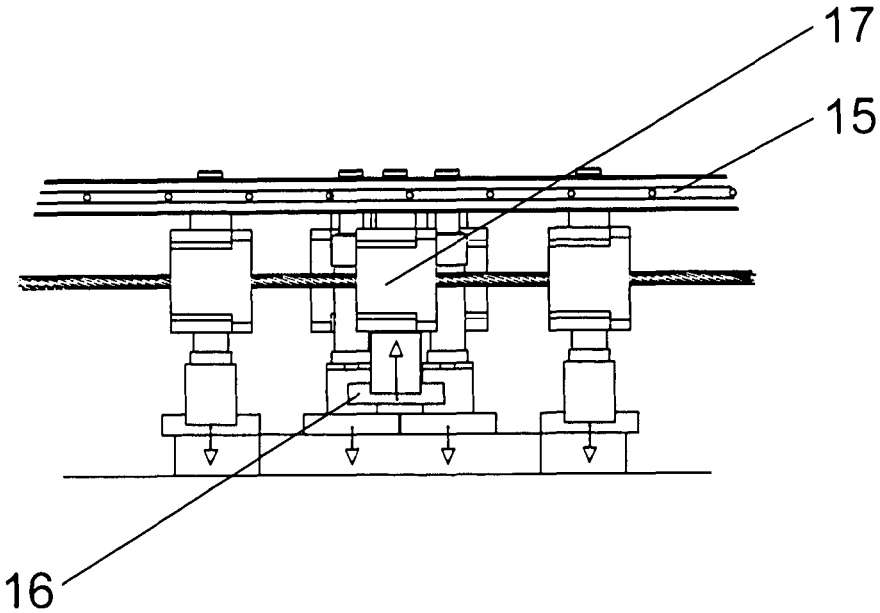
FIG. 6 illustrates a side view of the mobile pressure devices on the workpiece.
Figure 7:
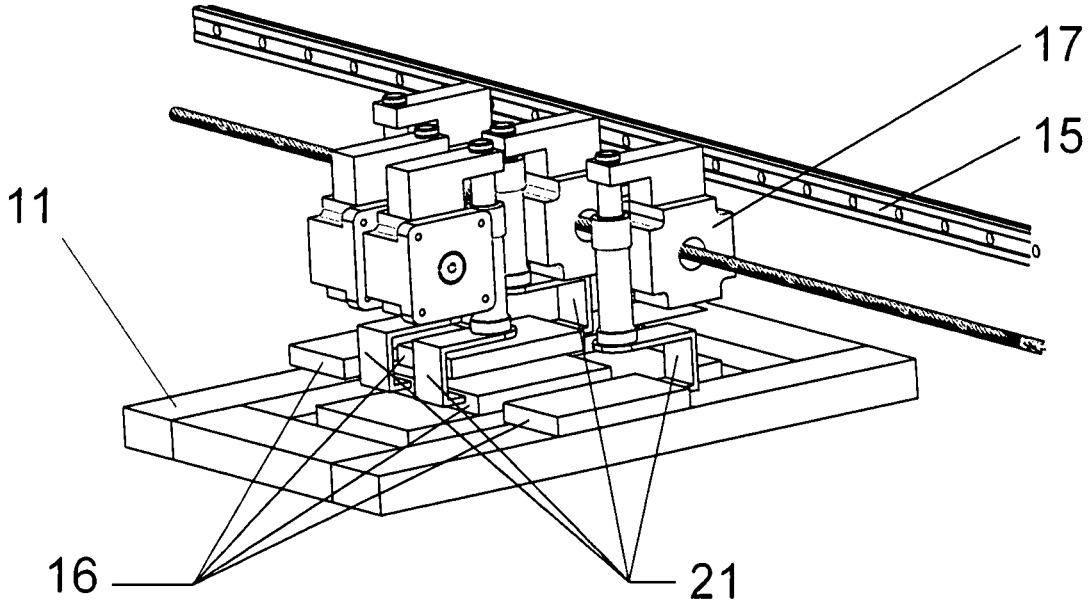
FIG. 7 illustrates a view of the mobile pressure device with an offset attachment.
Figure 8:
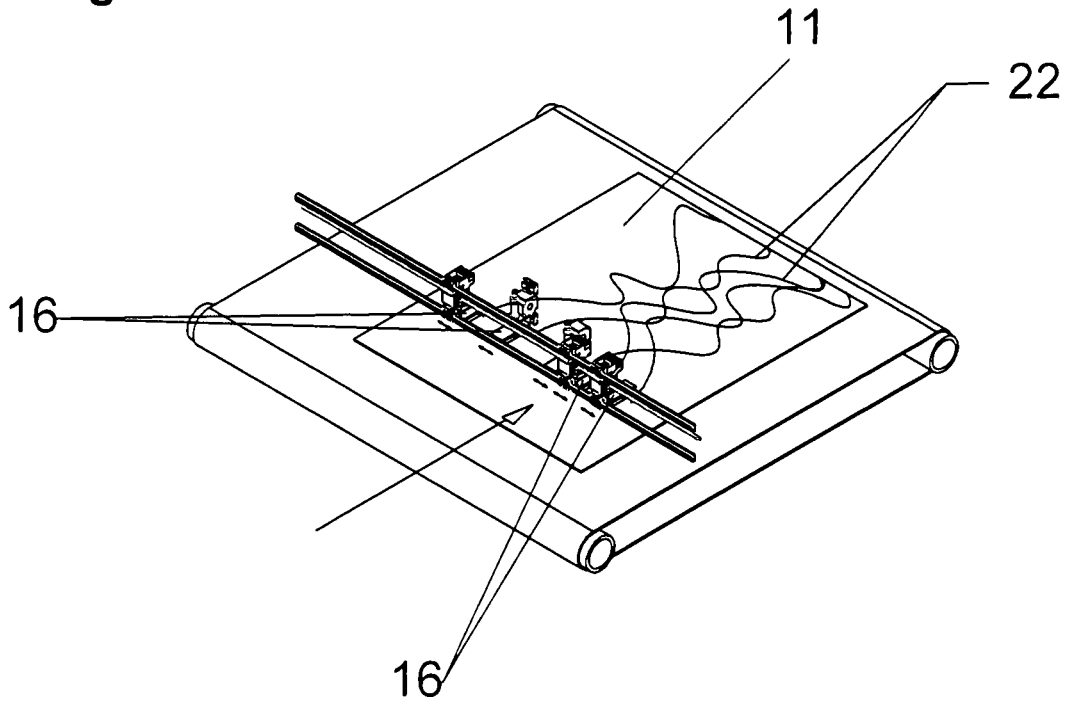
FIG. 8 illustrates the mobile pressure devices creating a sanding pattern.

FIG. 3 illustrates a common profile of the center panel 20 of a frame, symmetrical with respect to both longitudinal grain sections 18 and cross grain sections 19 (stiles and rails). FIG. 4 illustrates a method which, by using laterally mobile pressure devices 16, solves both the sanding of the longitudinal grain sections 18 (stiles) of a frame without touching its cross grain areas 19 (rails), and the sanding of the center panel 20 internal to the frame, by placing the mobile pressure devices 16 accordingly. FIG. 5 is a representation analogous to FIG. 4, whereby, however, for the purpose of sanding the center panel 20, individual or several mobile pressure devices 16 additionally oscillate (represented by an arrow line). FIG. 6 illustrates the lifting of individual mobile pressure devices 16 to a higher level when they are not in use. FIG. 7 illustrates an offset attachment 21 of the mobile pressure devices 16. FIG. illustrates the use of the mobile pressure devices 16 to create a customizable sanding pattern 22.

Laterally precise mobile pressure devices 16 are used in particular for sanding frames with both the longitudinal grain sections 18 and the cross grain sections 19 After the entire frame has been sanded crosswise, the longitudinal grain sections 18 (stiles) are re-sanded to exactly the same position so that the sanding direction and the wood grain direction are the same for all parts of the workpiece 11. If the center panel 20 of the frame are also to be sanded, further mobile pressure devices 16 are used in the same pass, either individually or in rows. Since frame center panel 20, as shown in FIG. 3, usually have a distance to the surrounding longitudinal grain sections 18 and cross grain sections 19, an approximate positioning of the mobile pressure devices 16 is usually sufficient for sanding them. If this cannot be done or cannot be done with sufficient accuracy, an oscillating movement of the mobile pressure devices 16 will solve the problem. The oscillation enables the processing of a wider area than the width of the mobile pressure devices 16 themselves. The use of the mobile pressure devices 16 for sanding the center panel 20 takes place with a time delay to the use of those of the longitudinal grain sections 18. They can only start after the passage of the first cross grain section 19 and must stop before the passage of the second cross grain sections 19. The timing of the mobile pressure devices 16 on the longitudinal grain sections 18, on the other hand, only has to take into account the leading and trailing workpieces 11.

In principle, mobile pressure devices 16 can be installed without spacing over the entire width of a throughfeed machine and thus optionally also function like a segmented sanding pad of conventional design, as well as being installed only in a limited number. In applications such as frame sanding or the creation of special sanding patterns, any number of mobile pressure devices 16 are raised to a second level, as illustrated in FIG. 6 in order to provide space for the mobile pressure devices 16 remaining below to move laterally.

As mentioned, one arrangement of pressure devices is the conventional segmented sanding pad. The present invention therefore also describes the extension and modification of the segmented sanding pad, firstly by the lateral, powered movement of the mobile pressure devices 16 on guides 15, which includes their ability to oscillate, secondly by an offset attachment 21 (cranked support) such that the mobile pressure devices 16 moving in opposite directions are able to cross each other, and further by the lifting of the mobile pressure devices 16 not only for the purpose of their non-use, but also to make room for the movement of further mobile pressure devices 16. These extensions provide the sanding device with additional functions that also enable it to solve the tasks described at the beginning. The space-saving and thus cost-saving implementation is ensured by the offset attachment 21 instead of the previously known central mounting of the segments 13.

The invention claimed is:

1. A method of operating a sanding device with a plurality of mobile pressure devices, each mobile pressure device of the plurality of mobile pressure devices is aligned laterally along a rail and each mobile pressure device of the plurality of mobile pressure devices is configured to move laterally relative to all of the other mobile pressure devices of the plurality of mobile pressure devices along the rail, the method comprising laterally displacing at least one mobile pressure device of the plurality of mobile pressure devices, individually oscillating each mobile pressure device of the plurality of mobile pressure devices in a lateral direction independent of all of the other mobile pressure devices, moving upward the at least one mobile pressure device of the plurality of mobile pressure devices in a direction perpendicular to the lateral direction such that oppositely mounted mobile pressure devices of the plurality of mobile pressure devices opposite to the at least one mobile pressure device can move laterally directly under the at least one mobile pressure device, holding the at least one mobile pressure device with an offset attachment so that the oppositely mounted mobile pressure devices can move laterally directly under the at least one mobile pressure device.

2. A sanding device comprising:

a rail;

a plurality of mobile pressure devices, each mobile pressure device of the plurality of mobile pressure devices is aligned laterally along the rail and each mobile pressure device of the plurality of mobile pressure devices is configured to move laterally relative to all of the other mobile pressure devices of the plurality of mobile pressure devices along the rail, wherein each mobile pressure device of the plurality of mobile pressure devices is configured to individually oscillate in a lateral direction independent of all of the other mobile pressure devices, and wherein at least one mobile pressure device of the plurality of mobile pressure devices is configured to move upward in a direction perpendicular to the lateral direction such that oppositely mounted mobile pressure devices of the plurality of mobile pressure devices opposite to the at least one mobile pressure device can move laterally directly under the at least one mobile pressure device; and an offset attachment that is configured to hold the at least one mobile pressure device so that the oppositely mounted mobile pressure devices can move laterally directly under the at least one mobile pressure device.

3. The sanding device according to claim 2, wherein the each mobile pressure device of the plurality of mobile pressure devices is configured to move laterally relative to all of the other mobile pressure devices of the plurality of mobile pressure devices along the rail via a motor.

4. The sanding device according to claim 2, wherein the plurality of mobile pressure devices are configured to move laterally in order to achieve both a first configuration in which there is no space between adjacent mobile pressure devices of the plurality of mobile pressure devices and a second configuration in which there is a space between the adjacent mobile pressure devices of the plurality of mobile pressure devices.

* * * * *